US006945413B1

(12) United States Patent
Meyer

(10) Patent No.: US 6,945,413 B1
(45) Date of Patent: Sep. 20, 2005

(54) PORTABLE POOL STICK RACK

(76) Inventor: Joshua G. Meyer, 16914 260th St., Clarks Grove, MN (US) 56016

( * ) Notice: Subject to any disclaimer, the term of this patent is extended or adjusted under 35 U.S.C. 154(b) by 0 days.

(21) Appl. No.: 10/741,329

(22) Filed: Dec. 22, 2003

(51) Int. Cl.[7] ..... A47F 7/00
(52) U.S. Cl. ..... 211/68
(58) Field of Search ..... 211/68, 90.03, 211/67, 62, 61, 14, 63, 88.03

(56) References Cited

U.S. PATENT DOCUMENTS

| | | | | | |
|---|---|---|---|---|---|
| 352,844 | A | * | 11/1886 | Ulings | 211/63 |
| 411,521 | A | * | 9/1889 | Haskell | 211/63 |
| D28,264 | S | * | 2/1898 | Walker | D8/376 |
| 616,555 | A | * | 12/1898 | Paddock et al. | 211/62 |
| 634,526 | A | * | 10/1899 | Holmes | 211/63 |
| 2,028,694 | A | * | 1/1936 | Spinks | 211/65 |
| 2,063,289 | A | * | 12/1936 | Alusas | 47/40 |
| 4,116,342 | A | | 9/1978 | Winfree, Jr. | |
| 4,903,929 | A | | 2/1990 | Hoffman | |
| 5,072,908 | A | * | 12/1991 | Lodrick | 248/231.81 |
| 5,139,221 | A | | 8/1992 | Lodrick | |
| 5,255,799 | A | * | 10/1993 | Haynes | 211/68 |
| D387,114 | S | | 12/1997 | Bliss | |
| 5,957,291 | A | | 9/1999 | Whitfield, Sr. | |

* cited by examiner

*Primary Examiner*—Sarah Purol

(57) ABSTRACT

A rack assembly includes a clamp including first and second members pivotally connected to each other. The first and second members include first and second jaw portions integral therewith, and are selectively engageable with each other for removably attaching to a support surface. The clamp further includes a spring member connected to the first and second members for causing the first member to automatically move to an original position after being pivoted towards the second member. The rack assembly further includes a rack connected to the clamp and extends outwardly therefrom adjacent the first and second members. The rack may be permanently secured to the clamp or may be removably engaged with the clamp via a fastening member.

12 Claims, 4 Drawing Sheets

PORTABLE POOL STICK RACK

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

The present invention relates to holders for supporting elongated members in a generally upright position and, more particularly, to a portable holder for pool sticks that may be detachably connected to a table, ledge, or the like.

2. Prior Art

In the game of billiards or pool, it is common for a player not currently shooting to rest his cue or stick against a convenient support surface, such as the arm of a chair. Due to the tapered, cylindrical shape of the cue, the cue can easily roll along the support surface and fall to the floor resulting in damage or even breakage of the cue tip or the cue itself.

While only a single billiard cue or pool stick is necessary to play billiards, billiard players are predisposed to their own favorite cues for a variety of reasons. Increasingly, these cues have fancy and elaborate finishes and include coatings and inlays of precious and rare materials. The cues may be easily scratched or damaged. For these reasons, the cues must be handled and stored carefully.

Stationery and wall mounted cue holders are well known. While these holders serve their purpose, they have limitations. These holders may not be located near the area of play. Additionally, when players bring their own cues to a match, the stationery holder may not accommodate the number of cues.

What is needed is an easily repositionable holder which can securely hold a billiard or pool cue in a generally upright position when not in use so as to prevent the cue from falling to the floor. While racks are well known for supporting a number of billiard/pool cues when the cues are not in use, such racks are typically mounted in one location, such as on a wall, and away from the location of chairs typically situated around a billiard/pool table. Thus, it is inconvenient for a player to have to place his cue in a central rack each time he/she temporarily finishes shooting.

Thus, it would be desirable to provide a holder for supporting an elongated object or member in a generally upright position that is easily repositionable and mountable on various support surfaces convenient to a user. It would also be desirable to provide a holder that prevents an elongated object supported in a generally upright position from falling to the floor. It would also be desirable to provide a holder that is specifically designated to support a billiard/pool cue in a generally upright position when the cue is not in use. It would also be desirable to provide a holder for supporting a billiard/pool cue that is easily and releasably mountable on a support surface. Finally, it would be desirable to provide a billiard/pool cue holder that is inexpensive in manufacturing cost and easy to use.

Accordingly, a need remains for a portable cue holder that may be transported to a desired site and may be detachably connected to nearly any flat surface for securely retaining a pool cue without scratching, marring or otherwise damaging the cue shaft.

BRIEF SUMMARY OF THE INVENTION

In view of the foregoing background, it is therefore an object of the present invention to provide a portable apparatus for holding pool sticks. These and other objects, features, and advantages of the invention are provided by a rack assembly for holding pool sticks that includes a clamp including first and second members pivotally connected to each other.

The first and second members include first and second jaw portions integral therewith and preferably formed from rubber material, for example. Such jaw portions are selectively engageable with each other for removably attaching to a support surface. The clamp further has first and second handle portions integral with the first and second jaw portions respectively, and extending rearwardly therefrom. The clamp has a longitudinal axis and further includes a spring member disposed substantially perpendicular to the axis and connected to the first and second members. The spring member provides resistive force for causing the first member to automatically move to an original position after being pivoted towards the second member.

The rack assembly further includes a rack connected to the clamp and extending outwardly therefrom adjacent the first and second handle portions. A fastening member secures the rack to the clamp. The rack includes a central portion and a plurality of rings integral therewith and formed about the central portion. The plurality of rings receive a plurality of pool sticks therethrough respectively for maintaining same at substantially vertical positions. The rack further includes a body formed from a stiff material and an outer cover disposed about the body and preferably formed from plastic.

In a preferred embodiment, the central portion is engaged with the clamp generally medially between the first and second jaw portions and the first and second handles portions respectively. The first and second jaw portions each have a threaded hole formed therein and aligned with each other respectively. In an alternate embodiment, a fastening member is removably insertable into the holes of the first and second jaw portions with the rack being positionable between the fastening member and the clamp.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
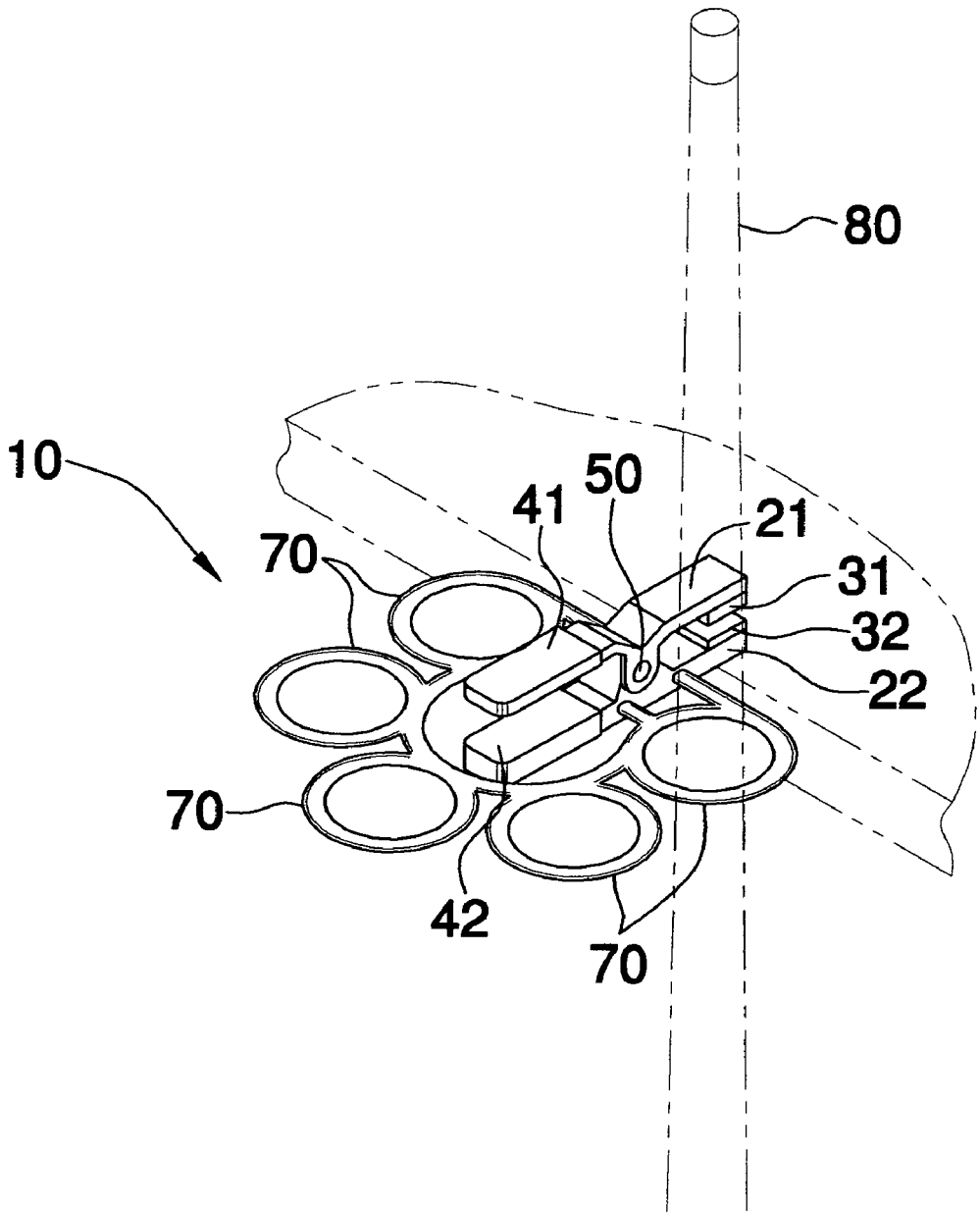
FIG. 1 is a perspective view showing a portable pool stick rack in a preferred environment, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide a portable pool stick rack assembly. It should be understood that the rack assembly 10 may be used to hold many different types of elongated members and should not be limited to holding only pool sticks.

Figure 3:
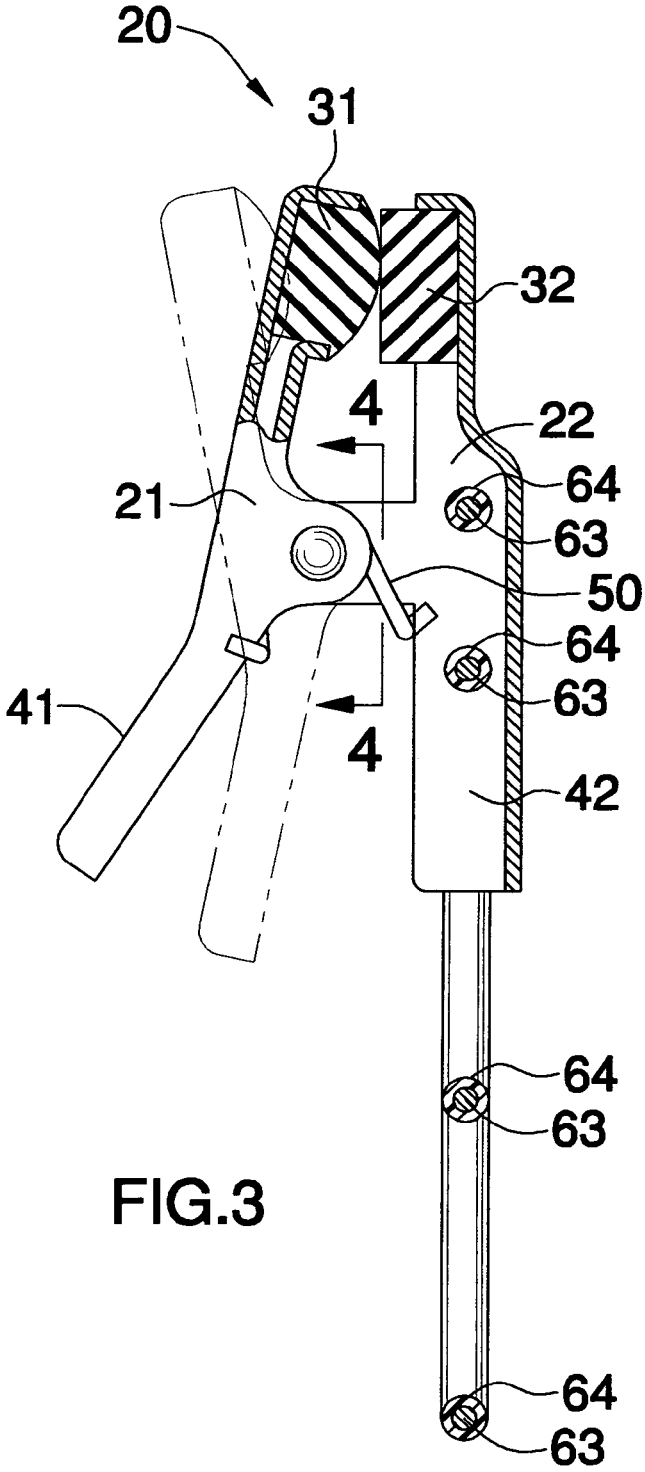
FIG. 3 is a cross-sectional view of the clamp and plurality of rings, taken along line 3—3.
Figure 4:
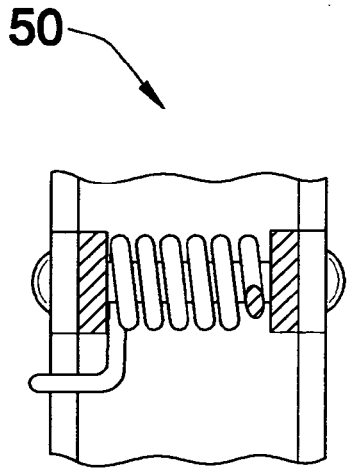
FIG. 4 is a cross-sectional view of the spring member, taken along line 4—4.

Initially referring to FIG. 3, a first embodiment of the rack assembly 10 includes a clamp 20 including first 21 and second 22 members pivotally connected to each other. The first 21 and second 22 members include first 31 and second 32 jaw portions, integral therewith and preferably formed from rubber material. Such jaw portions are selectively engageable with each other for removably attaching to a support surface. The jaw portions 31, 32 enable a user to attach the clamp 20 to nearly any flat support surface such as a table, chair arm, ledge, shelf or the like. Advantageously, this enables a user to transport the rack assembly 10 to a desired site and still be able to maintain his/her pool stick in a secure, substantially vertical position when not in use. Furthermore, this helps prevent damage to the pool stick and ensures that a player or spectator will not trip over a pool stick not in use. The clamp 20 further has first 41 and second 42 handle portions integral with the first 31 and second 32 jaw portions respectively, and extending rearwardly therefrom.

The clamp 20 has a longitudinal axis and further includes a spring member 50 disposed substantially perpendicular to the axis and connected to the first 21 and second 22 members. The spring member 50 provides resistive force for causing the first member 21 to automatically move to an original position after being pivoted towards the second member 22, as perhaps best shown in FIG. 4. The resistive force of the spring member 50 ensures that the jaw portions 31, 32 remain securely clamped to a support surface, thereby preventing the rack assembly 10 from releasing from a support surface and falling to the floor.

Figure 2:
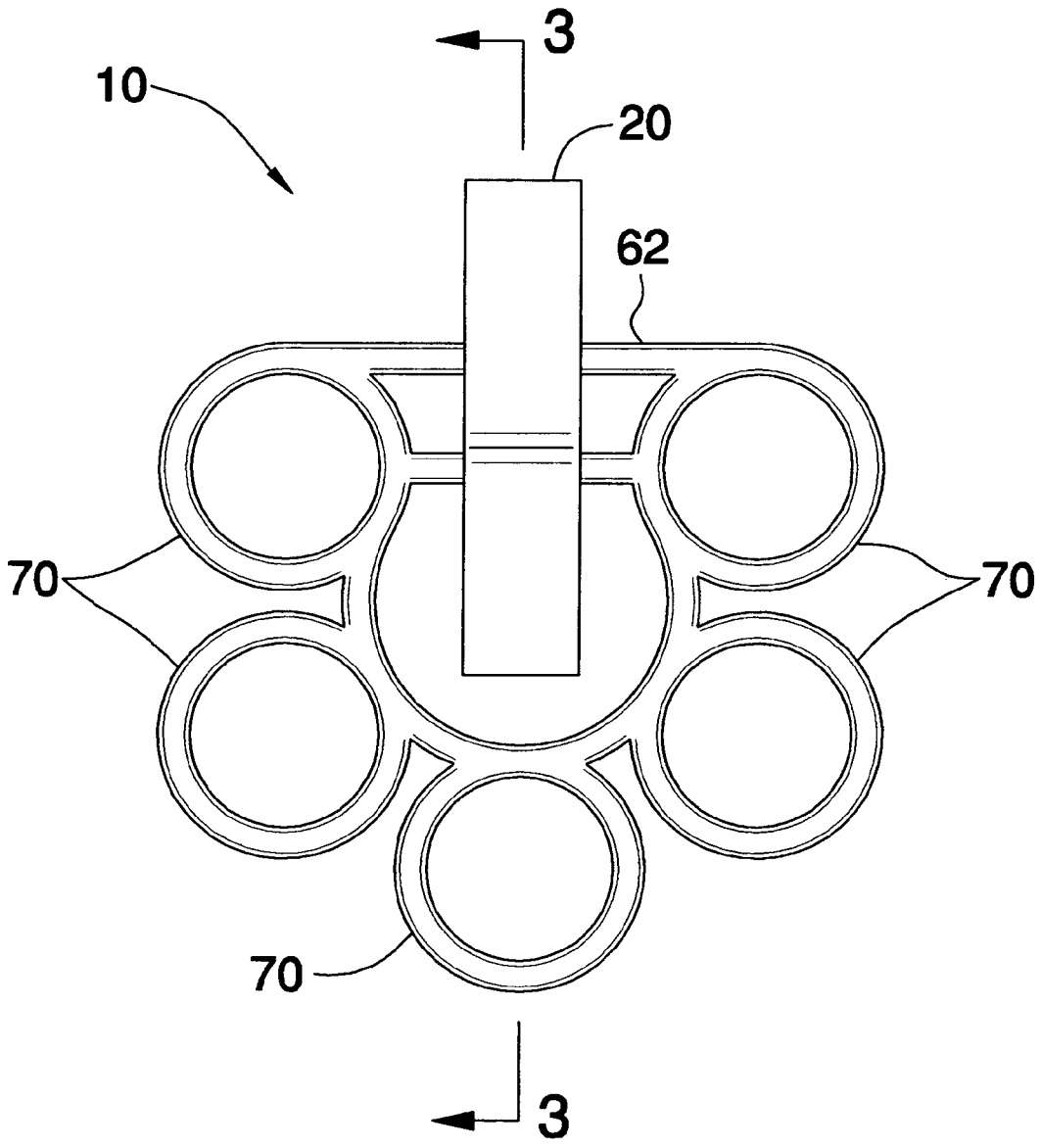
FIG. 2 is an enlarged top plan view of FIG. 1.

As perhaps best shown in FIG. 2 the current embodiment of the rack assembly 10 further includes a rack 60 connected to the clamp and extending outwardly therefrom adjacent the first 41 and second 42 handle portions. The rack 60 includes a central portion 62 and a plurality of rings 70 integral therewith and formed about the central portion 62, as perhaps best shown in FIG. 2. The plurality of rings 70 receive a plurality of pool sticks 80 therethrough respectively for maintaining same at substantially vertical positions, as perhaps best shown in FIG. 1. The rack 60 further includes a body 63 formed from a stiff material and an outer cover 64 disposed about the body 63 and preferably formed from plastic to prevent marring and scratching of a pool stick's surface, as perhaps best shown in FIG. 3.

In such an embodiment, the central portion 62 is engaged with the clamp 20 generally medially between the first 31 and second 32 jaw portions and the first 41 and second 42 handle portions respectively. The medial placement of the rack 60 provides stability and enables the rack 60 to support the weight of a plurality of pool sticks 80.

Figure 5:
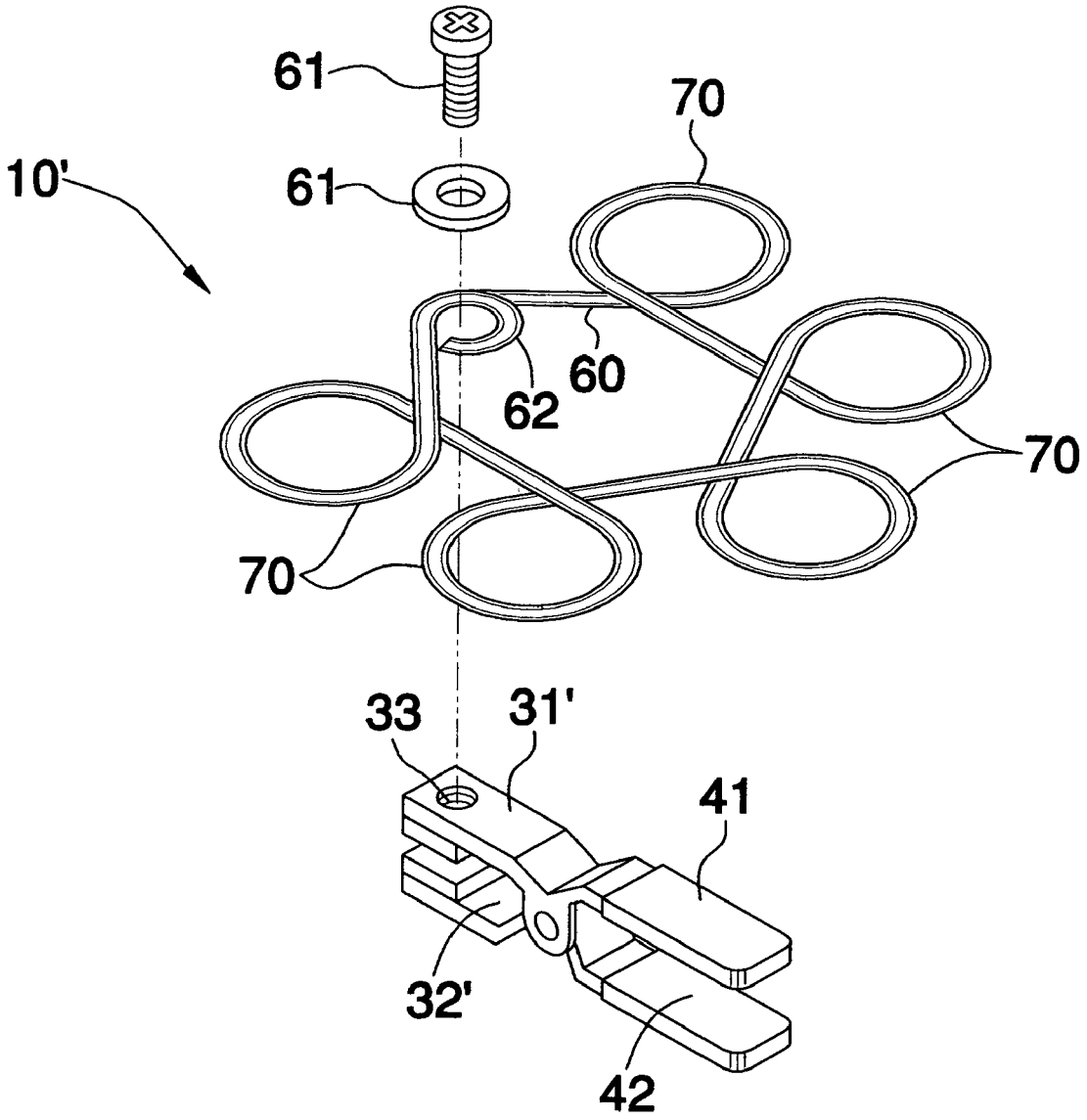
FIG. 5 is an exploded perspective view showing an alternate embodiment of the present invention.

In an alternate embodiment, as best shown in FIG. 5, the first 31' and second 32' jaw portions each have a threaded hole 33 formed therein and aligned with each other respectively. Such an embodiment further includes a fastening member 61 for securing the rack 60' to the clamp 20'. In particular, the fastening member 61 is removably insertable into the holes of the first 31' and second 32' jaw portions with the rack 60' being positionable between the fastening member 61 and the clamp 20'.

The rack assembly 10 provides a convenient method for storing pool sticks 80 when not in use, or when the number of pool sticks 80 in use exceeds the available storage on a permanent rack already in place. This eliminates many safety concerns because a pool stick 80 has a pointed end that could injure a person if accidentally toppled from a leaning position. In addition, a pool stick 80 that has fallen on the floor presents a safety hazard because its tapered, cylindrical shape gives it a tendency to roll if stepped upon by a person. This could cause the person to lose his/her balance and fall.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A rack assembly for holding pool sticks and comprising:

a clamp including first and second members pivotally connected to each other, said first and second members including first and second jaw portions integral therewith and selectively engageable with each other for removably attaching to a support surface, said first and second jaw portions each have a threaded hole formed therein and aligned with each other respectively, said clamp further having first and second handle portions integral with said first and second jaw portions respectively and extending rearwardly therefrom;

a rack connected to said clamp and extending outwardly therefrom adjacent said first and second handle portions, said rack including a central portion and a plurality of rings integral therewith and formed about said central portion, said plurality of rings for receiving a plurality of pool sticks therethrough respectively and for maintaining same at substantially vertical positions; and a fastening member for securing said rack to said clamp, said fastening member being removably insertable into the holes of said first and second jaw portions with said rack being positionable between said fastening member and said clamp.

2. The rack assembly of claim 1, wherein said central portion is engaged with said clamp generally medially between said first and second jaw portions and said first and second handle portions respectively.

3. The rack assembly of claim 1, wherein said first and second jaw portions are formed from rubber material.

4. The rack assembly of claim 1, wherein said rack further comprises:

a body formed from a stiff material; and an outer cover disposed about said body and being formed from plastic.

5. The rack assembly of claim 1, wherein said clamp has a longitudinal axis and further comprises a spring member connected to said first and second members, said spring member being disposed substantially perpendicular to the axis, said spring member providing resistive force for causing said first member to automatically move to an original position after being pivoted towards said second member.

6. A rack assembly for holding pool sticks and comprising:

a clamp including first and second members pivotally connected to each other, said first and second members including first and second jaw portions integral therewith and selectively engageable with each other for removably attaching to a support surface, said first and second jaw portions each have a threaded hole formed therein and aligned with each other respectively, said clamp further having first and second handle portions integral with said first and second jaw portions respectively and extending rearwardly therefrom;

a rack connected to said clamp and extending outwardly therefrom adjacent said first and second handle portions, said rack including a central portion and a plurality of rings integral therewith and formed about said central portion, said plurality of rings for receiving a plurality of pool sticks therethrough respectively and for maintaining same at substantially vertical positions, said central portion being engaged with said clamp generally medially between said first and second jaw portions and said first and second handle portions respectively; and a fastening member for securing said rack to said clamp, said fastening member being removably insertable into the holes of said first and second jaw portions with said rack being positionable between said fastening member and said clamp.

7. The rack assembly of claim 6, wherein said first and second jaw portions are formed from rubber material.

8. The rack assembly of claim 6, wherein said rack further comprises:

a body formed from a stiff material; and an outer cover disposed about said body and being formed from plastic.

9. The rack assembly of claim 6, wherein said clamp has a longitudinal axis and further comprises a spring member connected to said first and second members, said spring member being disposed substantially perpendicular to the axis, said spring member providing resistive force for causing said first member to automatically move to an original position after being pivoted towards said second member.

10. A rack assembly for holding pool sticks and comprising;

a clamp including first and second members pivotally connected to each other, said first and second members including first and second jaw portions integral therewith and selectively engageable with each other for removably attaching to a support surface, said first and second jaw portions each have a threaded hole formed therein and aligned with each other respectively, said clamp further having first and second handle portions integral with said first and second jaw portions respectively and extending rearwardly therefrom;

a rack connected to said clamp and extending outwardly therefrom adjacent said first and second handle portions, said rack including a central portion and a plurality of rings integral therewith and formed about said central portion, said plurality of rings for receiving a plurality of pool sticks therethrough respectively and for maintaining same at substantially vertical positions, said central portion being engaged with said clamp generally medially between said first and second jaw portions and said first and second handle portions respectively, said rack further comprising a body formed from a stiff material, and an outer cover disposed about said body and being formed from plastic; and a fastening member for securing said rack to said clamp, said fastening member being removably insertable into the holes of said first and second jaw portions with said rack being positionable between said fastening member and said clamp.

11. The rack assembly of claim 10, wherein said first and second jaw portions are formed from rubber material.

12. The rack assembly of claim 10, wherein said clamp has a longitudinal axis and further comprises a spring member connected to said first and second members, said spring member being disposed substantially perpendicular to the axis, said spring member providing resistive force for causing said first member to automatically move to an original position after being pivoted towards said second member.

* * * * *